United States Patent [19]

Hoffman

[11] 4,260,159

[45] Apr. 7, 1981

[54] ELECTRONIC ROULETTE GAME

[75] Inventor: Jerzy Hoffman, Santa Monica, Calif.

[73] Assignee: Tritech Corporation, Calif.

[21] Appl. No.: 68,676

[22] Filed: Aug. 22, 1979

[51] Int. Cl.[3] ..... A63F 5/00

[52] U.S. Cl. ..... 273/138 A

[58] Field of Search ..... 35/138 A, 1 E, 1 GC; 340/323 R

[56] References Cited

U.S. PATENT DOCUMENTS 3,895,807 7/1975 Friedman ..... 273/138 A

OTHER PUBLICATIONS

*Radio-Electronics*; "Electronic Casino"; Mar. 1974; pp.45, 50–52, 86.

*Electronics Australia*; "An Electronic Roulette Wheel"; Feb. 1976; pp.46–51.

*Popular Electronics*; "Have Fun with Electronic Dice"; Jul. 1975; pp. 48, 49.

*Popular Electronics*; "Electronic Wheel of Fortune"; Oct. 1975; pp. 69, 70.

*Primary Examiner*—Vance Y. Hum

*Attorney, Agent, or Firm*—Philip Hoffman

[57] ABSTRACT

An electronic game simulating a roulette wheel whereby 38 light emitting diodes are circularly disposed. The diodes are sequentially illuminated so that a light appears to move circularly. A pulse generator, including a voltage controlled oscillator, activates a 4-by-10 matrix counter to sequentially light said diodes. A discharging capacitor controls the length of time the pulses are generated. A speaker coupled to the pulse generator simulates the sound of the ball hopping on the roulette wheel.

3 Claims, 1 Drawing Figure

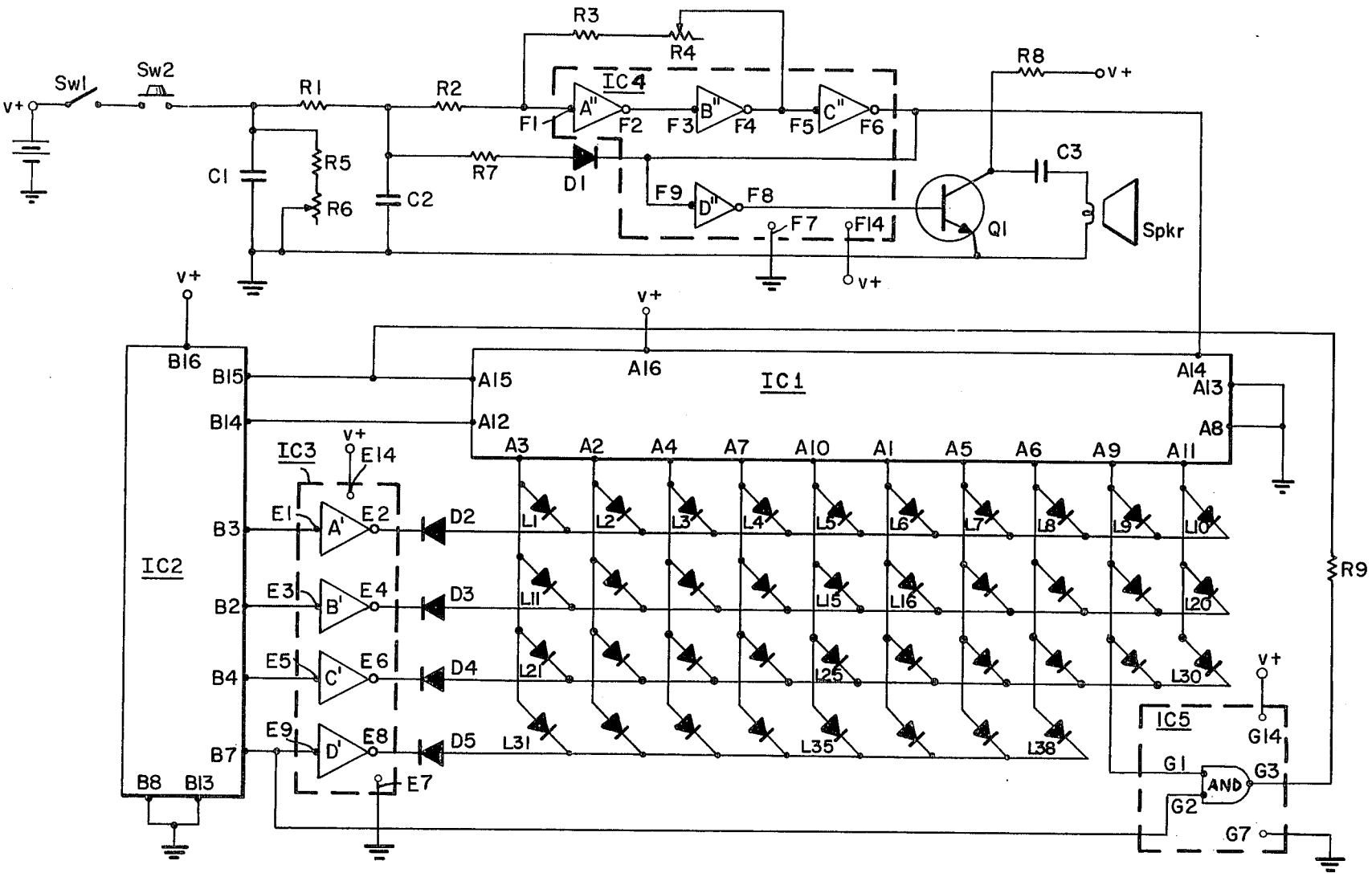
R9
V+
G14
G3
AND
G7
G1
G2
IC5
A14
A13
A8
A11
A9
A6
A5
A1
A10
A7
A4
A2
A3
A16
A15
A12
IC1
L10
L20
L30
L9
L8
L38
L7
L6
L16
L5
L15
L25
L35
L4
L3
L2
L1
L11
L21
L31
Spkr
C3
R8
Q1
F14
F7
F8
F9
F6
F5
F4
F3
F2
F1
C"
B"
A"
D"
R4
R3
IC4
D1
R7
R2
C2
R1
R5
R6
C1
Sw2
Sw1
D2
D3
D4
D5
E7
E14
E2
E4
E6
E8
A'
B'
C'
D'
IC3
E1
E3
E5
E9
B15
B14
B3
B2
B4
B7
B16
B13
B8
IC2

ELECTRONIC ROULETTE GAME

This invention relates generally to electronic games of chance and more specifically to electronic roulette games with visual displays.

Various articles have appeared in the literature discussing electronic roulette games. David Edwards' article entitled "An Electronic Roulette Wheel" appearing in the February, 1976 edition of *Electronics Australia* teaches an electronic roulette game with only 36 numbers, whereas a conventional roulette wheel has 38.

Waller M. Scott's article in *Radio Electronics,* 1974, entitled "Electronic Casino", teaches an electronic roulette game with 38 numbers, but the editor of the publication notes that he had received no evidence of a working model. Furthermore Scott's circuit uses 7 transistors, and his counter or shift register uses 19 integrated circuits, rendering the circuit complex and necessitating excessive wiring.

It is desirable to have an electronic roulette game providing 38 numbers, and having a minimum of circuit elements. Accordingly it is an object of the present invention to provide an electronic roulette game with 38 numbers.

Another object of this invention is to provide a circuit for an electronic roulette game whose counter comprises only 4 integrated circuit elements and no transistors.

It is still a further object of the present invention to provide an electronic roulette game whose counter comprises 2 integrated circuit decade counters.

Yet another object of this invention is to provide an electronic roulette game with a minimum of circuit elements.

These and other objects and advantages of the present invention are provided by an electronic roulette game comprising: 38 light emitting diodes physically disposed circularly to simulate the 38 numbers on a roulette wheel, and wired in a $4\times10$ matrix, wherein the matrix has ten groups of common anodes and four groups of common cathodes; a source of direct current; a switch adapted for momentary manual actuation coupled to the direct current source; a pulse generator coupled to the switch; illuminating means, including two decade counters, for illuminating the 38 lights sequentially and repetitively; terminating means, including a discharging capacitance, coupled to the pulse generator and to the source for randomly terminating the repetitive sequential illumination while leaving one of the 38 lights illuminated, that light being randomly determined for each activation of the switch; and sound means coupled to the pulse generator for sounding the sequential illumination.

The invention is described in greater detail in conjunction with the accompanying drawing FIG. 1, which is an electronic schematic representation of an embodiment of the invention.

Referring now to the FIG. 1, there is shown a $4\times10$ matrix of 38 light emitting diodes L1–L38 connected to two decade counters IC1 and IC2. The diodes L1–L38 represent the numbers on a roulette wheel, 1–36, 0 and 00, and are physically disposed in a circle to simulate a roulette wheel. The counters IC1 and IC2 are complementary metal on semi-conductor (CMOS) integrated circuits, such as CD4017B, and are connected to diodes L1–L38 so as to sequentially activate them, as further discussed below. IC1 and IC2 each comprise ten output terminals. Eight of the output terminals on IC1 are each connected to the anodes of four light emitting diodes (heretofore referred to as LEDs), while the remaining two are each connected to the anodes of three, thus accounting for all 38 LEDs. As shown output terminal A3 of IC1 is connected to the anodes of L1, L11, L21 and L31; A2 to L2, L12, L22 and L32; A4 to L3, L13, L23 and L33; A7 to L4, L14, L24 and L34; A10 to L5, L15, L25 and L35; A1 to L6, L16, L26 and L36; A5 to L7, L17, L27 and L37; A6 to L8, L18, L28 and L38; A9 to L9, L19 and L29; A11 to L10, L20 and L30. The cathodes of the LEDs are connected together in three groups of ten and one group of eight, each cathode group being connected to the anodes of a gate diode. Thus the cathodes of L1–L10 are connected to the anode of D2; L11–L20 to D3; L21–L30 to D4; L31–L38 to D5. The cathodes of gate diodes D2–D5 are respectively connected to the output terminals E2, E4, E6 and E8 of inverters A′, B′, C′ and D′, respectively, which comprise a CMOS integrated circuit IC3, such as CD 4069B. Input terminals E1, E3, E5 and E9 of said IC3 inverters are connected, respectively, to the first four output terminals of IC2, namely B3, B2, B4 and B7. The remaining six output terminals of IC2, which are not shown, are not used here because the matrix includes only 38 LEDs, and therefore the counting goes no higher than 38.

IC1, IC2 and IC3 receive energy via terminals A16, B16 and E14, respectively, from the direct current source V+, which is preferably a 9-volt battery, and are grounded via terminals A8, B8 and E7, respectively. The carry out terminal A12 of IC1 is connected to the clock terminal B14 of IC2. The clock enable terminals A13 and B13 of IC1 and IC2, respectively, are grounded. The carry out terminal of IC2 (not shown) is not used. The clock terminal A14 of IC1 receives a negative pulse from a pulse generator as discussed below.

The sequential activation of the LEDs is achieved as follows: Initially only one LED is on. Nine of the output terminals of IC1 are initially in a "0" logic state, and the tenth terminal is in a "1" logic state. The "1" logic state forward biases the LEDs connected to that terminal. Three of the four output terminals in use on IC2 are in a "0" logic state, and the fourth is in a "1" logic state. Of the LEDs connected to said tenth terminal of IC1, i.e. the terminal in the "1" logic state, only one of those LEDs will be activated, because it has an open path for current to flow. This can be understood more readily by way of example. Assume terminals A10 and B2 are in a "1" logic state. The anodes of L5, L15, L25 and L35 would have a positive voltage, but only L15 will conduct. The "1" logic state of terminal B2 provides a positive voltage signal to inverter B′, which inverts the signal to a negative voltage at its output terminal E4. This negative voltage causes diode D3 to conduct, completing the conduction path for L15. Since the terminals B3, B4 and B7 are in a "0" logic state, inverters A′, C′ and D′, respectively, receive negative voltage signals which are inverted to positive voltages at E2, E6 and E8, respectively, thereby blocking diodes D2, D4 and D5, respectively, and thereby preventing L5, L25 and L35, respectively, from conducting.

The counter on IC1 is triggered by the positive going edge of the incoming pulse at A14, which causes the next output terminal, in this case A1, to switch to a "1" logic state, while A10 is switched back to a "0" logic state. Thus L16 will be emitting light, until the positive going edge of the next pulse arrives at A14. When the last output terminal in IC1, A11, is switched from logic state "1" back to logic state "0" the first output terminal A3 goes to logic state "1" and the carry out terminal A12 presents a positive going signal to the clock terminal B14 of IC2, switching B2 to "0" logic state and B4 to a "1" logic state. This causes L21 to conduct and therefore emit light.

Terminals A9 and B7 are connected to terminals G1 and G2, respectively, of IC5 which is one AND element of a CMOS integrated circuit, such as CD4081B. IC5 receives energy via terminal G14 which is connected to V+ and is grounded at terminal G7. When A9 and B7 are both in "1" logic states, the AND output terminal G3 will provide a positive signal to reset terminals A15 and B15 of IC1 and IC2, respectively, through an isolation resistor R9. This occurs when L38 is switched to "0" logic state by the positive going edge of the next incoming pulse at A14. The sequence is then repeated until the pulses cease.

The pulse generator referred to above comprises inverter elements A", B" and C" of a CMOS integrated circuit IC4, such as CD4069B. IC4 receives energy from V+ via terminal F14 and is grounded at terminal F7. The output terminal F2 of A" is connected to the input terminal F3 of B", and the output terminal F4 of B" is connected to the series combination of resistor R3 and potentiometer R4 which provides a feedback path to input terminal F1 of A". This arrangement of A", B", R3 and R4 comprise a voltage controlled oscillator. The output terminal F4 is connected to input terminal F5 of inverter C". The output terminal F6 is connected to the cathode of diode D1. The anode of D1 is connected to resistor R7 which in turn is connected to the junction of isolation resistor R1, coupling resistor R2 and voltage-controlling capacitor C2. Since R2 is connected to terminal F1 a feedback path is established from terminal F6 to terminal F1. Diode D1 allows only the negative portion of the output to appear at F1 therefore the pulse generator furnishes only negative pulses at F6.

The controlling voltage input signal to the oscillator is furnished by capacitor C2 as follows: With power switch SW1 closed, when the pushbutton activation switch SW2 is depressed, source capacitant C1 charges essentially immediately to the source voltage of V+, producing that voltage across the series combination of isolation resistor R1 and capacitor C2. The voltage on C2 is reduced in amplitude by coupling resistor R2 and appears at the input terminal F1 of the oscillator. When the switch SW2 is released C1 discharges through the series combination of resistor R5 and potentiometer R6, said series combination being in parallel with C1. This discharge decreases the voltage on C2 and consequently at the oscillator input, which in turn reduces the oscillator frequency, until finally, the oscillations cease and no more pulses are generated. When this occurs the last LED to be illuminated remains illuminated, and designates the winning roulette number for that "spin".

The analogy between the present invention and a conventional roulette wheel is as follows: Closing the power switch SW1 is analogous to the croupier spinning the wheel. Closing and releasing the activation switch is analogous to the croupier releasing the ball. The time it takes for C1 to discharge is analogous to the time it takes the ball to land on a number. The frequency with which the LEDs switch is directly related to the frequency of the pulses and that is analogous to the movement of the ball as it hops and rolls counter to the wheel.

The discharge time of C1 is controlled by the value of R5+R6. The greater the resistance, the longer the discharge time. The oscilator frequency is controlled by a complex R-C timing circuit, comprising C2, R3, R4, R2 and R7. The greater the resistance R3+R4, the lower the frequency. The randomness of the result is increased by a long discharge time and a high oscillator frequency. However, the discharge time cannot be too great because the time between spins will be too long. Nor would too great a frequency be desirable because the sequential lighting of the LEDs would be too fast for the human eye to notice. Thus, a discharge time of five seconds and an initial frequency of about 40 cycles per second would be satisfactory.

The sound of the conventional roulette wheel is simulated by activating a speaker SPKR with the pulse from the pulse generator as follows: The output terminal F6 is connected to input terminal F9 of an inverter D" which is provided by IC4. The output terminal F8 of inverter D" is coupled to the base of transistor Q1 whose emitter is grounded. The collector is coupled through resistor R8 to the voltage supply V+, and through series capacitor C3 to the speaker SPKR. When a negative pulse appears at terminal F9 a positive pulse appears at the base of Q1, forward biasing Q1. This causes current to flow from V+ through R8, collector and emitter, to ground. As the pulse forward biases Q1, the voltage at the collector changes from essentially V+ to essentially ground, and this change is coupled through C3 to the speaker causing an audible click.

The following is an example of the parameters used in a working embodiment of this invention. While not limiting the scope of the invention, the parameters may be useful in enabling persons skilled in the art to make a model of the invention.

| | |
|---|---|
| Transistor Q1 | Type 2N2222 |
| Integrated Circuits | |
| IC1 and 2 | Type CD4017B |
| IC3 and 4 | Type CD4069B |
| IC5 | Type CD4081B |
| Diodes D1-5 | Type IN914 |
| Light Emitting Diodes L1-38 | Type TIL210 |
| Speaker SPKR | 8 Ohms |
| Capacitors | |
| C1 | 50 mfd |
| C2 | 1.5 mfd |
| C3 | 4 mfd |
| Potentiometers | |
| R4 | 1 Meg |
| R6 | 500 K |
| Resistors | |
| R1 and 5 | 100 K |
| R2 | 150 K |
| R3 | 2.2 Meg |
| R7 and 8 | 10 K |
| R9 | 47 K |

There has thus been shown and described an electronic roulette game simulating a mechanical roulette wheel. Although specific embodiments of the invention have been described in detail, other variations of the embodiments shown may be made within the spirit, scope and contemplation of the invention.

Accordingly it is intended that the foregoing disclosure and drawing shall be considered only as illustrations of the principles of this invention and are not to be construed in a limiting sense.

What is claimed is:

1. An electronic roulette game comprising:

(a) 38 light emitting diodes (LEDs) positioned to simulate the 38 numbers on a roulette wheel and interconnected in a 4×10 matrix wherein:

the anodes of said LEDs are arranged in ten groups, the first through eighth of said anode groups each commonly connecting four anodes, and the ninth and tenth commonly connecting three;

the cathodes of said LEDs are arranged in four groups, the first, second and third of said cathode groups each commonly connecting ten cathodes, and the fourth commonly connecting eight; and each of said first through eighth anode groups have first, second, third and fourth LEDs with cathodes connected, respectively, to said first, second, third and fourth cathode groups, and each of said ninth and tenth anode groups have first, second and third LEDs with cathodes connected, respectively, to said first, second and third cathode groups;

(b) a source of direct current;

(c) a switch adapted for momentary manual actuation coupled to said source;

(d) a pulse generator coupled to said switch, said pulse generator comprising:

a voltage controlled oscillator;

an inverter coupled to the output terminal of said oscillator;

a feedback diode coupling the output terminal of said inverter through a coupling resistance to the input terminal of said oscillator; and a control-voltage capacitance coupled through said coupling resistance to the input terminal of said oscillator;

(e) illuminating means coupled to said pulse generator for illuminating said 38 LEDs sequentially and repetitively, said illuminating means comprising:

a first counter coupled to said direct current source and having: first through tenth output terminals coupled, respectively, to said first through tenth anode groups; and a first clock terminal coupled to said pulse generator;

a second counter coupled to said direct current source and having: first through fourth output terminals coupled, respectively, to said first through fourth cathode groups so that when the anodes of any one of said anode groups are positively biased, only one LED in said one of said anode groups will conduct; a second clock terminal coupled to a carry terminal of said first counter; and a second reset terminal coupled to a first reset terminal of said first counter; and an AND gate coupled to said direct current source and having: a first input terminal coupled to said ninth anode group; a second input terminal coupled to said fourth cathode group; and an output terminal coupled to said first and second reset terminals;

(f) means coupled to said pulse generator and to said switch for randomly terminating said repetitive sequential illumination while leaving one of said 38 LEDs illuminated, said one of said LEDs being randomly determined for each activation of said switch; and (g) means coupled to said pulse generator for sounding said sequential illumination.

2. The device claimed in claim 1 wherein said terminating means comprises:

a source capacitance coupled to said direct current source; and a timing resistance in parallel with said source capacitance, said parallel resistance-capacitance combination being coupled through an isolation resistance to said control-voltage.

3. The device claimed in claim 2 wherein said sounding means comprises:

a transistor coupled to the output terminal of said pulse generator through its base terminal, coupled to ground through its emitter terminal and coupled to said direct current source through its collector terminal; and a speaker whose first terminal is coupled through a series capacitance to said collector, and whose second terminal is coupled to said emitter.

* * * * *